US005497958A

United States Patent [19]

Orf et al.

[11] Patent Number: 5,497,958

[45] Date of Patent: Mar. 12, 1996

[54] FENCING MATERIAL DISPENSER

[76] Inventors: Ronald F. Orf; Sandra L. Orf, both of 111 McJury La., Lafayette, Tenn. 37083

[21] Appl. No.: 306,627

[22] Filed: Sep. 15, 1994

[51] Int. Cl.[6] ..... B65H 16/04; B65H 75/02

[52] U.S. Cl. ..... 242/597.7; 242/406

[58] Field of Search ..... 242/597.7, 406, 242/129

[56] References Cited

U.S. PATENT DOCUMENTS

| | | | |
|---|---|---|---|
| Re. 34,376 | 9/1993 | Branback | 242/129 |
| D. 261,634 | 11/1981 | Beshears | D12/2 |
| D. 301,667 | 6/1989 | Barrs et al. | D6/518 |
| D. 324,617 | 3/1992 | McCauley | D6/518 |
| D. 329,773 | 9/1992 | Addison et al. | D6/520 |
| 1,281,802 | 10/1918 | Madill | 242/597.7 X |
| 1,488,541 | 4/1924 | Hasen | 242/597.7 |
| 1,933,163 | 10/1933 | Coplen | 242/597.7 X |
| 2,990,135 | 6/1961 | Croteau et al. | 242/597.7 X |
| 3,414,211 | 12/1968 | Roberts | 242/406 X |
| 3,815,842 | 6/1974 | Scrogin | 242/597.7 X |
| 4,184,647 | 1/1980 | Rourke | 242/597.7 X |
| 4,278,257 | 7/1981 | Garcia et al. | 242/406 X |
| 4,353,512 | 10/1982 | Rohrbacher . | |
| 5,158,243 | 10/1992 | Sigle et al. | 242/597.7 X |

*Primary Examiner*—John M. Jillions

[57] ABSTRACT

A dispenser for facilitating the unrolling of a spool of fence material arranged in a vertical orientation. The inventive device includes a base member having a plurality of ground-engaging stakes for piercing a ground surface. A rotatable platform is mounted to the basement member and supports an end of the spool to permit the spool to rotate relative to the ground surface. A center rod member extends through a center of the spool and through both the rotatable platform and base member to pierce and engage the ground surface therebeneath. Guy wires may also be attached to an upper distal end of the center member to impart further stabilization of the device.

5 Claims, 4 Drawing Sheets

FENCING MATERIAL DISPENSER

BACKGROUND OF THE INVENTION

1. Field of the Invention

The present invention relates to dispensing structures and more particularly pertains to a fencing material dispenser for facilitating the unrolling of a spool of fence material arranged in a vertical orientation.

2. Description of the Prior Art

The use of dispensing structures is known in the prior art. More specifically, dispensing structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art dispensing structures include U.S. Pat. No. 4,353,512; U.S. Pat. No. D,324,617; U.S. Pat. No. D,329,773; U.S. Pat. No. D,301,667; and U.S. Pat. No. D,261,634.

While these devices fulfill their respective, particular objectives and requirements, the aforementioned patents do not disclose a dispenser for facilitating the unrolling of a spool of fence material which includes a base member having a plurality of ground-engaging stakes, a rotatable platform mounted to the base member for supporting an end of the spool in a rotatable position relative to the ground surface, and a center rod member extending through a center of the spool and through both the rotatable platform and the base member to pierce an engaged ground surface. Furthermore, none of the known prior art dispensing structures teach or suggest a device of the aforementioned configuration which further includes guy wires attached to an upper distal end of the center member and engagable to the ground surface or other supporting structure to further stabilization of the device.

In these respects, the fencing material dispenser according to the present invention substantially departs from the conventional concepts and designs of the prior art, and in so doing provides an apparatus primarily developed for the purpose of facilitating the unrolling of a spool of fence material arranged in a vertical orientation.

SUMMARY OF THE INVENTION

In view of the foregoing disadvantages inherent in the known types of dispensing structures now present in the prior art, the present invention provides a new fencing material dispenser construction wherein the same can be utilized for unrolling a spool of fence material. As such, the general purpose of the present invention, which will be described subsequently in greater detail, is to provide a new fencing material dispenser apparatus and method which has many of the advantages of the dispensing structures mentioned heretofore and many novel features that result in a fencing material dispenser which is not anticipated, rendered obvious, suggested, or even implied by any of the prior art dispensing structures, either alone or in any combination thereof.

To attain this, the present invention generally comprises a dispenser for facilitating the unrolling of a spool of fence material arranged in a vertical orientation. The inventive device includes a base member having a plurality of ground-engaging stakes for piercing a ground surface. A rotatable platform is mounted to the basement member and supports an end of the spool to permit the spool to rotate relative to the ground surface. A center rod member extends through a center of the spool and through both the rotatable platform and base member to pierce and engage the ground surface therebeneath. Guy wires may also be attached to an upper distal end of the center member to impart further stabilization of the device.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fencing material dispenser apparatus and method which has many of the advantages of the dispensing structures mentioned heretofore and many novel features that result in a fencing material dispenser which is not anticipated, rendered obvious, suggested, or even implied by any of the prior art dispensing structures, either alone or in any combination thereof.

It is another object of the present invention to provide a new fencing material dispenser which may be easily and efficiently manufactured and marketed.

It is a further object of the present invention to provide a new fencing material dispenser which is of a durable and reliable construction.

An even further object of the present invention is to provide a new fencing material dispenser which is susceptible of a low cost of manufacture with regard to both materials and labor, and which accordingly is then susceptible of low prices of sale to the consuming public, thereby making such fencing material dispensers economically available to the buying public.

Still yet another object of the present invention is to provide a new fencing material dispenser which provides in the apparatuses and methods of the prior art some of the advantages thereof, while simultaneously overcoming some of the disadvantages normally associated therewith.

Still another object of the present invention is to provide a new fencing material dispenser for facilitating the unrolling of a spool of fence material arranged in a vertical orientation.

Yet another object of the present invention is to provide a new fencing material dispenser which includes a base member having a plurality of ground-engaging stakes, a rotatable platform mounted to the base member for supporting an end of the spool in a rotatable position relative to the ground surface, and a center rod member extending through a center of the spool and through both the rotatable platform and the base member to pierce an engaged ground surface.

Even still another object of the present invention is to provide a new fencing material dispenser of the aforementioned structure which further includes guy wires coupled to an upper distal end of the center member and engagable to a ground surface or other supporting structure to further stabilization of the device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
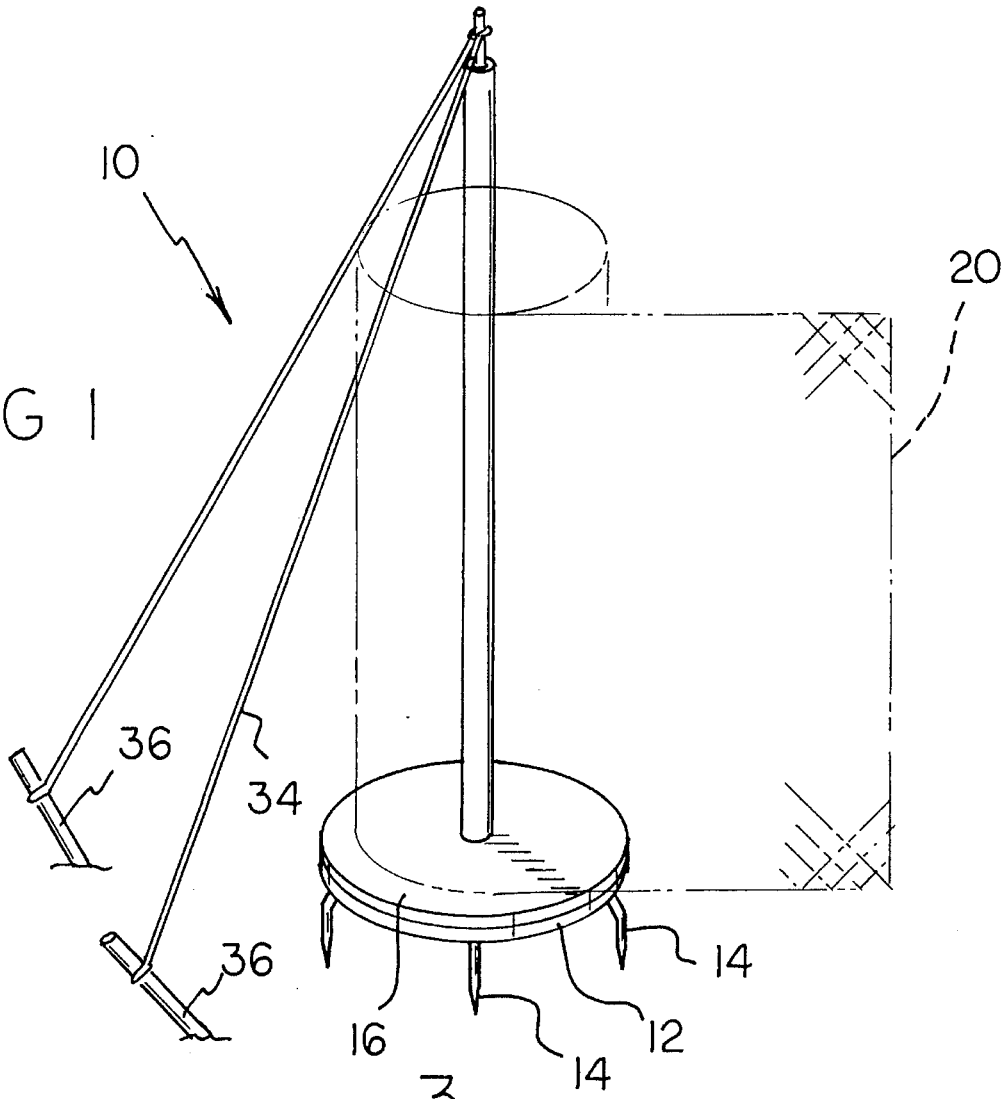
FIG. 1 is an isometric illustration of a fencing material dispenser according to the present invention in use.

With reference now to the drawings, and in particular to FIGS. 1–6 thereof, a new fencing material dispenser embodying the principles and concepts of the present invention and generally designated by the reference numeral 10 will be described.

More specifically, it will be noted that the fencing material dispenser 10 comprises a substantially planar base member 12 having an upper surface and a lower surface, with a plurality of base member stakes 14 projecting downwardly from the lower surface thereof. The base member stakes 14 are operable to pierce and engage a ground surface to support the base member 12 relative to the ground surface. A rotatable platform 16 is rotatably supported above the base member 12 by bearings 18 positioned between the rotatable platform and the base member, as shown in the cross-section illustration of FIG. 3. By this structure, the rotatable platform 16 can be rotated relative to the base member 12 such that a roll of fencing material 20 positioned upon the rotatable platform 16 can be dispensed therefrom.

Figure 3:
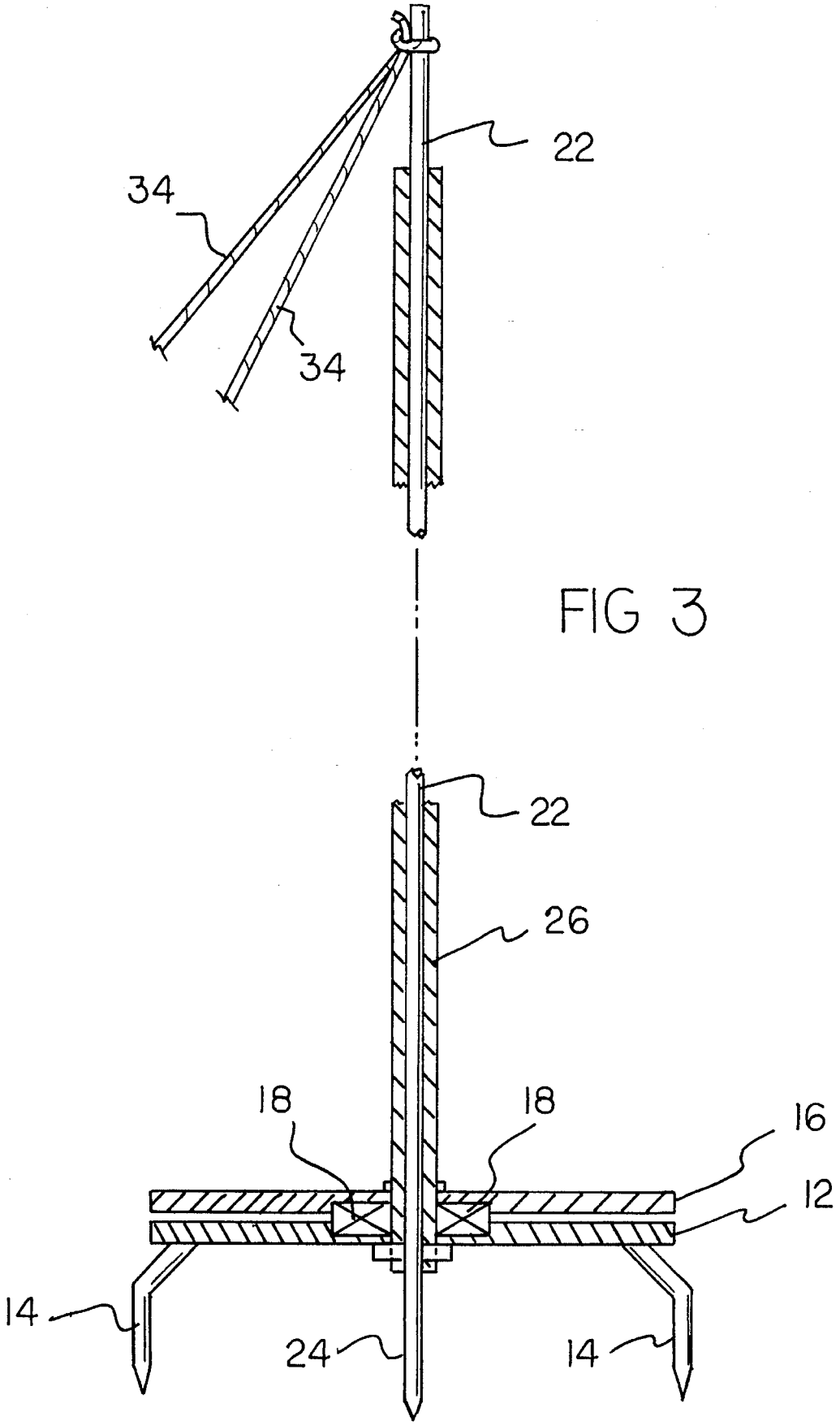
FIG. 3 is a cross-sectional view taken along line 3—3 of FIG. 2.
Figure 4:
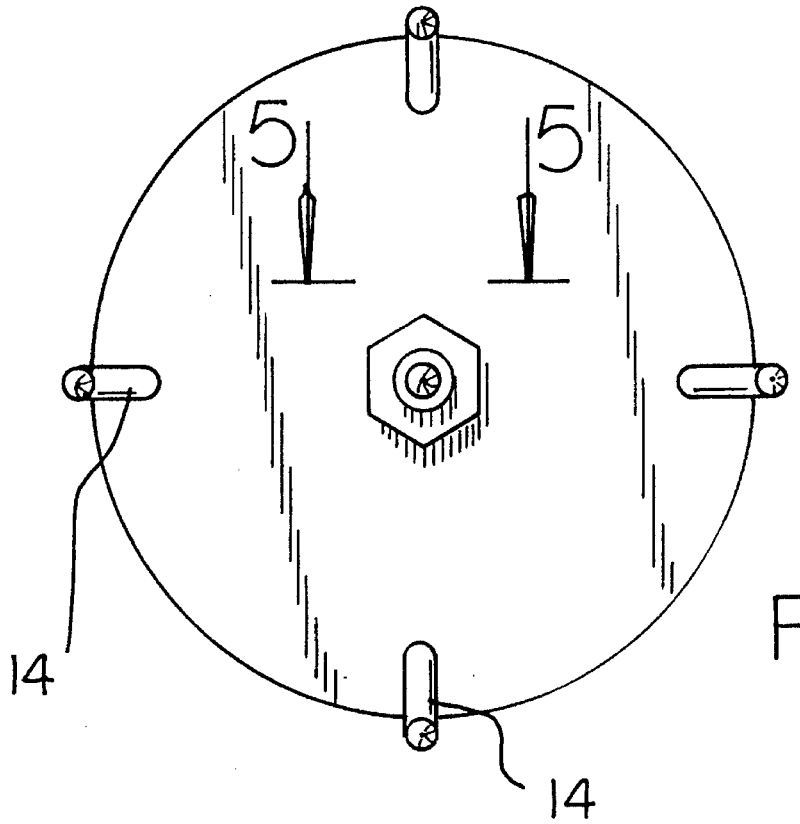
FIG. 4 is a bottom plan view of the invention.
Figure 5:
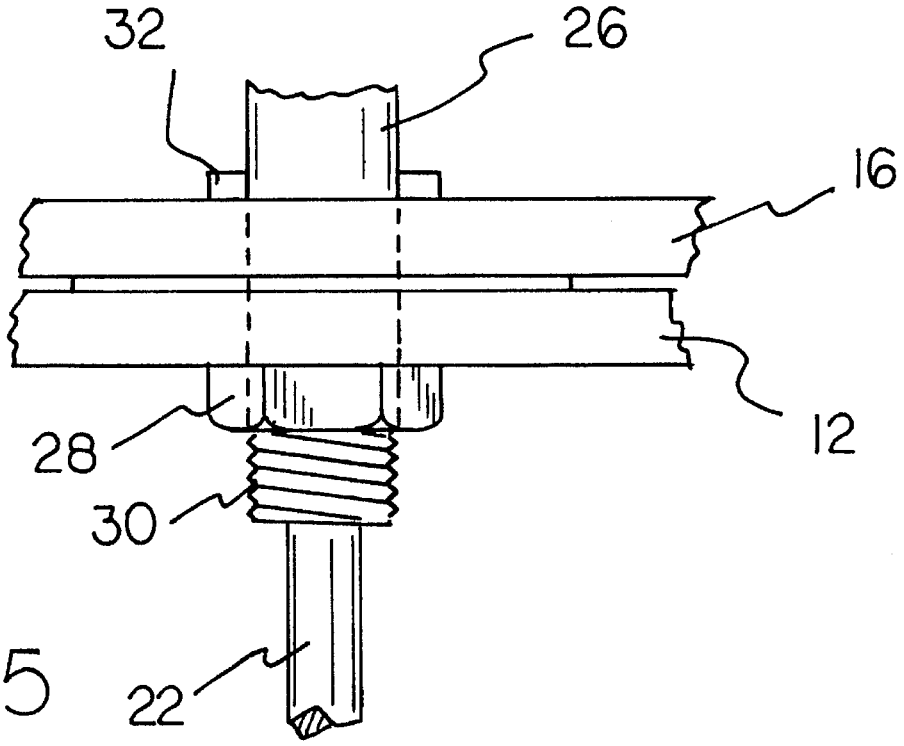
FIG. 5 is an enlarged side elevation view of a portion of the present invention.
Figure 6:
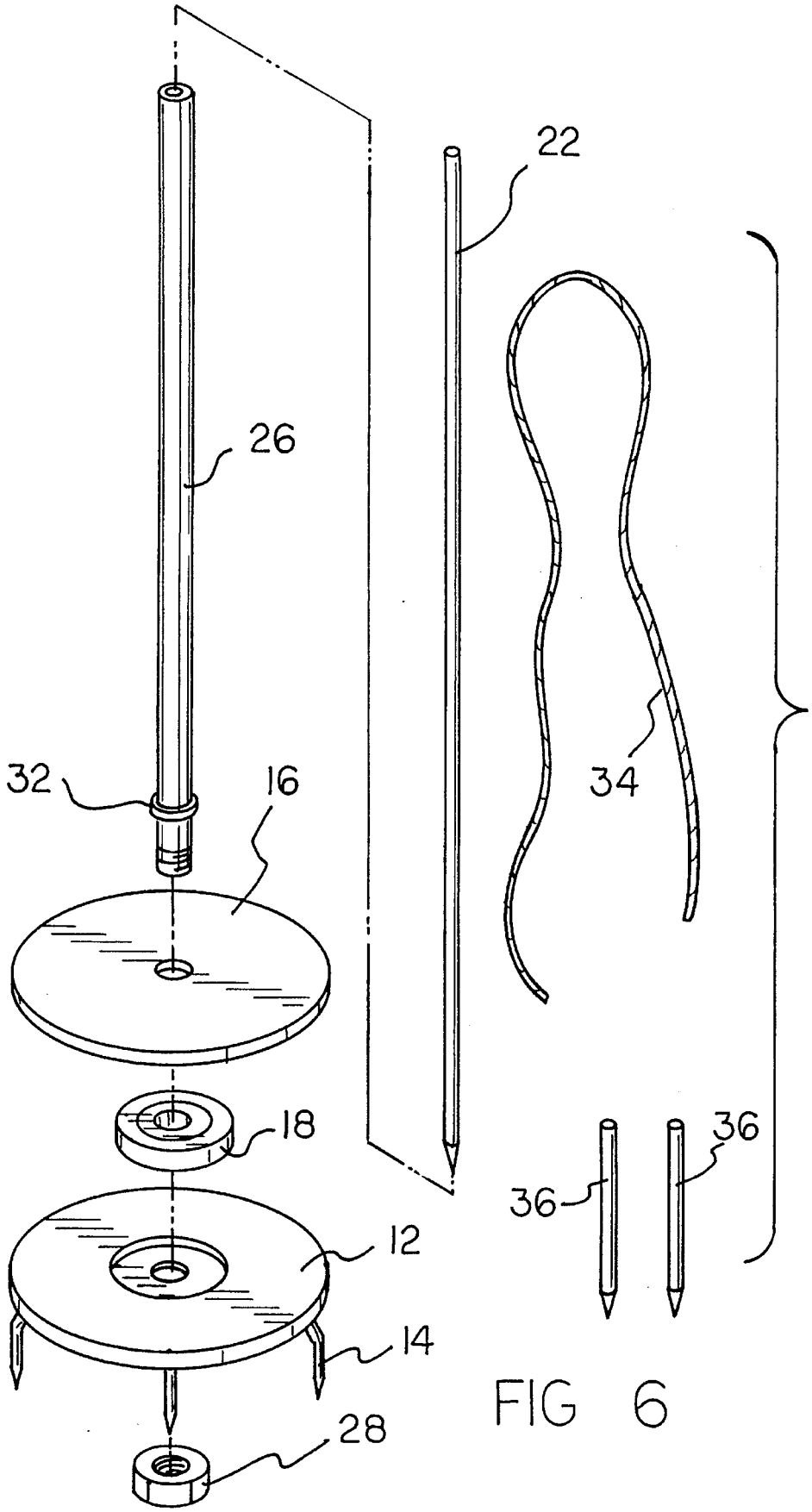
FIG. 6 is an exploded isometric illustration of the components of the invention.

To further stabilize the device 10, a center rod member 22 extends through a center of the fence roll 20 and through unlabelled center apertures in both the rotatable platform 16 and the base member 12 to engage the ground surface in a manner similar to that of the base member stakes 14. To this end, a lower distal end of the center member 22 is shaped so as to define a center member stake 24 capable of piercing and engaging the ground surface as described above. As best illustrated in FIGS. 3 and 5 of the drawings, a hollow tube 26 is concentrically disposed about the center member 22 so as to rotate with the rotatable platform 16. To this end, the tube 26 extends through the center, apertures in both the rotatable platform 16 and the base member 12 and is precluded from axial separation therewith by a nut 28 engaged to a threaded end 30 of the tube 26. A flange 32 secured about a portion of the tube 26 and spaced from the threaded end 30 precludes or limits passage of the tube 26 through the rotatable platform 16. By this structure, the device 10 may be easily assembled as shown in the exploded illustration of FIG. 6.

Figure 2:
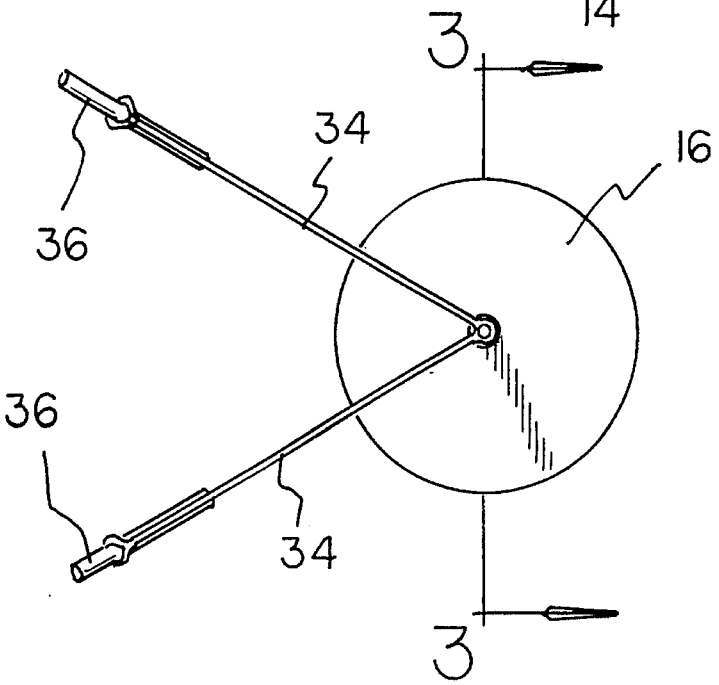
FIG. 2 is a top plan view of the invention.

To impart further stability to the device 10, at least one guy wire 34 may be selectively attached to an upper end of the center member 22 and secured to the ground surface by at least one stake member 36. Alternatively, the guy wire 34 may be attached directly to a surrounding support structure, such as a tree, a fencepost, or the like. Preferably, the guy wire 34 comprises a single length of flexible cable tied to the upper end of the center member 22 proximal a center portion of the cable, wherein opposed distal ends of the guy wire 34 are each attached to an individual stake member 36, as shown in FIGS. 1 and 2 of the drawings.

In use, the fencing material dispenser 10 provides a convenient means of unrolling a roll 20 of fence material with the fence material being arranged in a vertical orientation for subsequent attachment to a plurality of fenceposts during a fencing installation. To this end, the base member 12 is securable to the ground surface by an engagement of the base member stakes 14 to the ground surface. The fence roll 20 can then be positioned over the tube 26 and the center member 22, with the guy wires 34 being attached to the upper end of the center member 22 and secured to surrounding support structure or the stake members 36. Alternatively, the fence roll 20 may be positioned about the center member 22 and the tube 26 while the device 10 is positioned in a substantially horizontal orientation, wherein the loaded assembly may then be pivoted into the vertical orientation illustrated in FIG. 1, whereby a weight of the fence roll 20 and the device to will force the base member stakes 14, as well as the center member stake 24 into the ground surface. Regardless of the method of installation of the fence roll 20 onto the device 10, the fence roll can then be dispensed from the fencing material dispenser as desired to complete a fencing installation.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A fencing material dispenser comprising:

a base member having an upper surface and a lower surface, said base member including a center aperture extending therethrough;

a plurality of base member stakes projecting downwardly from said lower surface of said base member, said base member stakes being operable to pierce and engage a ground surface to support said base member relative to said ground surface;

a rotatable platform rotatably supported above said base member, said rotatable platform including a center aperture extending therethrough;

a center rod member extending through said center apertures in both said rotatable platform and said base member for engaging said ground surface, said center member having a lower distal end shaped so as to define a center member stake capable of piercing and engaging said ground surface;

a hollow tube concentrically and rotatably disposed about said center member so as to rotate with said rotatable platform;

wherein said hollow tube extends through said center apertures in both said rotatable platform and said base member and is precluded from axial separation therewith by a nut engaged to a threaded end of said tube, said tube further including a flange secured about a portion thereof spaced from said threaded end which limits a passage of said hollow tube through said center aperture of said rotatable platform.

2. The fencing material dispenser of claim 1, and further comprising at least one guy wire attached to an upper end of said center member.

3. The fencing material dispenser of claim 2, and further comprising at least one stake member coupled to a distal end of said at least one guy wire, said stake member being operable to pierce and engage said ground surface to anchor said distal end of said guy wire thereto.

4. The fencing material dispenser of claim 3, wherein said guy wire comprises a single length of flexible cable tied to said upper end of said center member proximal a center portion of said cable, wherein opposed distal ends of said guy wire are each attached to an individual stake member.

5. A fencing material dispenser comprising:

a base member having an upper surface and a lower surface, said base member including a center aperture extending therethrough;

a plurality of base member stakes projecting downwardly from said lower surface of said base member, said base member stakes being operable to pierce and engage a ground surface to support said base member relative to said ground surface;

a rotatable platform rotatably supported above said base member, said rotatable platform including a center aperture extending therethrough, said rotatable platform being rotatably supported above said base member by bearings positioned between said rotatable platform and said base member;

a center rod member extending through said center apertures in both said rotatable platform and said base member for engaging said ground surface, said center member having a lower distal end shaped so as to define a center member stake capable of piercing and engaging said ground surface;

a hollow tube concentrically and rotatably disposed about said center member so as to rotate with said rotatable platform, said hollow tube extending through said center apertures in both said rotatable platform and said base member and being precluded from axial separation therewith by a nut engaged to a threaded end of said tube, said tube further including a flange secured about a portion thereof spaced from said threaded end which limits a passage of said hollow tube through said center aperture of said rotatable platform;

at least one guy wire attached to an upper end of said center member;

and, at least one stake member coupled to a distal end of said at least one guy wire, said stake member being operable to pierce and engage said ground surface to anchor said distal end of said guy wire thereto, said guy wire comprising a single length of flexible cable tied to said upper end of said center member proximal a center portion of said wire, wherein opposed distal ends of said guy wire are each attached to an individual stake member.

* * * * *